US007246892B2

(12) United States Patent
Choi et al.

(10) Patent No.: US 7,246,892 B2
(45) Date of Patent: Jul. 24, 2007

(54) INK-CARTRIDGE FOR INKJET PRINTER

(75) Inventors: Sik-Sun Choi, Osan (KR); Jae-Cheol Lee, Gyunggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 185 days.

(21) Appl. No.: 10/759,085

(22) Filed: Jan. 20, 2004

(65) Prior Publication Data

US 2005/0036014 A1 Feb. 17, 2005

(30) Foreign Application Priority Data

Aug. 11, 2003 (KR) ..... 10-2003-0055301

(51) Int. Cl.
*B41J 2/175* (2006.01)

(52) U.S. Cl. ..... 347/86

(58) Field of Classification Search ..... 347/84–87, 347/92–93, 50

See application file for complete search history.

(56) References Cited

U.S. PATENT DOCUMENTS 5,975,687 A * 11/1999 Powers ..... 347/86
6,739,712 B2 * 5/2004 Kim ..... 347/87
2003/0137565 A1 * 7/2003 Sakuma ..... 347/69
2003/0142174 A1 * 7/2003 Boyd et al. ..... 347/85
2004/0032468 A1 * 2/2004 Killmeier et al. ..... 347/85
2004/0066433 A1 * 4/2004 Pingrey et al. ..... 347/86

FOREIGN PATENT DOCUMENTS

JP 10-058711 3/1998

* cited by examiner

*Primary Examiner*—Stephen Meier
*Assistant Examiner*—Jason Uhlenhake
(74) *Attorney, Agent, or Firm*—Roylance, Abrams, Berdo & Goodman, LLP

(57) ABSTRACT

An improved inkjet printer ink cartridge is provided having a print head unit and a housing. The print head unit has a head chip in which a nozzle hole is formed to fire ink onto paper, and a flexible circuit board for transceiving signals with a printer system. The housing has a receiving part at the bottom thereof to receive the print head unit, and an ink chamber disposed therein, the receiving part having an ink feed hole including a dam on its circumference, and a secondary dam of the same height as the dam. Accordingly, when attaching the print head unit into the housing print head receiving part, the print head unit is prevented from being slanted. Further, problems from heat stress when an adhesive is heat cured, such as a membrane crack, or a circuit wire or conductive path breaking, are minimized.

20 Claims, 7 Drawing Sheets

INK-CARTRIDGE FOR INKJET PRINTER

CROSS-REFERENCE TO RELATED APPLICATION

This application claims the benefit of Korean Application No. 2003-55301, filed Aug. 11, 2003, in the Korean Intellectual Property Office, the disclosure of which is incorporated herein by reference.

BACKGROUND OF THE INVENTION

1. Field of the Invention

The present invention relates to an inkjet printer, and more particularly to an ink cartridge having an improved structure, which is mounted in an inkjet printer.

2. Related Art

In general, demand for inkjet printers is increasing since an inkjet printer causes less noise, superior resolution, and is less costly for color representing. The inkjet printer performs printing work by attaching bubbles generated by heating an ink to a printing paper through nozzles. To do this work, the inkjet printer comprises a print head unit having a plurality of fine nozzle holes for firing an ink, and an ink cartridge for storing the ink.

FIG. 1A is a sectional side view of a conventional inkjet cartridge of an inkjet printer, and FIG. 1B is a bottom view of the same.

Referring to FIGS. 1A and 1B, the conventional inkjet cartridge of the inkjet printer comprises a housing 10 having an ink chamber 1 for storing an ink, a print head unit 20 connected to one side of the bottom of the housing 10, and a filter 30 for filtering the ink supplied to the print head unit 20.

The housing 10 is mounted on a cartridge (not shown) of the inkjet printer, and thus moves in association with the cartridge. An ink is ejected from the print head unit 20, thereby forming a desired image. At an inner bottom side of the housing 10, a stand pipe chamber 11 is formed for forming an ink path to supply the ink to the print head unit 20.

Between the stand pipe chamber 11 and the ink chamber 1 is disposed a filter 30 to filter the ink stored in the ink chamber 1 and supply the filtered ink to the stand pipe chamber 11.

A receiving part 15 is formed at the bottom of the housing 10 in which the print head unit 20 is received and fixed by an adhesive 19. At the bottom of the receiving part 15, an ink feed hole 17 is formed for forming the ink path. As a result, the ink is supplied to the print head unit 20 passing through the ink chamber 1, the filter 30, the stand pipe chamber 11, and the ink feed hole 17.

FIGS. 2A and 2C show a partially enlarged view of part 'A' of FIG. 1B. FIG. 2B is a cross-sectional view along a line II—II of FIG. 2A, and FIG. 2D is a cross-sectional view along a line II'—II' of FIG. 2C. Referring to FIGS. 2A and 2C, respectively, the ink feed hole 17 is formed either in the center or inclined to one side of the receiving part 15. In order to prevent the adhesive 19 from causing backflow toward the ink feed hole 17 when attaching the print head unit 20 to the receiving part 15, a dam 17*a* is formed on a circumference of the ink feed hole 17 of the receiving part 15. A thermosetting epoxy for the adhesive 19 is applied in a space between an outer wall 15*a* of the receiving part 15 and the dam 17*a*, and a head chip 21 is attached in precise arrangement. The head chip 21 is connected to a flexible circuit board 23 (FIG. 1A), and has a heating element (not shown) and a nozzle hole (not shown).

However, as shown in FIG. 3A, the head chip 21 and a bottom of the receiving part 15 are separated apart by a space S, which causes the head chip 21 to slant when attaching the head chip 21, as shown in FIG. 3B. In addition, the adhesive 19 may flow over the dam 17*a* to the ink feed hole 17, blocking the nozzle hole or contaminating the ink. Further, the ink drop may be ejected askew rather than vertically with respect to a printing paper. This can result in different arrival distances. Accordingly, an image quality is deteriorated due to the differences of ink dropping positions.

In addition, as shown in FIGS. 4A and 4B, a nozzle unit 21*a* of the head chip 21, in which the ink flows, is formed as a thin membrane. The print head unit 20 is attached by heat hardening the adhesive 19. At this time, the adhesive 19 is constantly heated more than an hour at high temperature exceeding 100° C. Therefore, the adhesive 19 expands as it is heat-hardened, thereby generating stress that extends to the print head chip 21. Due to the stress, problems usually occur in vulnerably structured print head chips, such as a crack in the membrane, a wire breaking, or breaking of electrically conductive patterns on the chip. Such problems are aggravated when the structure is not symmetrical due to the ink feed hole 17 being inclined to one side of the receiving part 15, or when a sealant is applied broader than the unapplied area, as shown in FIG. 2C. Moreover, the above problems also occur in the multiple color print head unit of a color ink cartridge of FIG. 4B.

SUMMARY OF THE INVENTION

The present invention has been made to overcome the above-mentioned problems of the prior art. Accordingly, it is an aspect of the present invention to provide an ink cartridge of an inkjet printer which is capable of attaching a print head unit parallel to a printing paper in a simple structure, and stabilizing a vulnerable structure part of the print head unit.

In order to achieve the above-described aspects of the present invention, there is provided an ink cartridge of an inkjet printer having a print head unit and a housing. The print head unit has a head chip in which a nozzle hole is formed to fire an ink onto a printing paper, and a flexible circuit board for transceiving signals with a printer system. The housing has a receiving part formed at one side of the bottom thereof to receive and fix the print head unit, and an ink chamber disposed therein. The receiving part has an ink feed hole including a dam on its circumference, and a secondary dam of the same height as the dam.

The housing comprises a stand pipe chamber inside near the receiving part. The ink cartridge further comprises a filter disposed between the ink chamber and the stand pipe chamber to filter the ink which is supplied to the print head unit.

The print head unit is receivingly fixed by an adhesive, in an area where the dam and the secondary dam are not formed, in the receiving part.

According to preferred embodiments of the present invention, in the adhesive-applied area in the receiving part, the secondary dam is formed in a broader side with respect to the ink feed hole. Here, it is preferred that one or more secondary dams are formed so that the adhesive-applied areas are symmetrical with respect to the ink feed hole.

Additionally, according to preferred embodiments of the present invention, the secondary dam is extended parallel to the ink feed hole, and at least one of the secondary dams is extended in a direction of the ink feed hole and parallel reciprocally.

Further, an area defined by outer circumference of the dam and the secondary dam is more than a half of the whole area of the receiving part.

As described above, according to the present invention, when attaching the print head unit into the print head receiving part of the housing, the print head unit can be prevented from slant attaching. Further, problems caused by heat stress occurring when an adhesive is heat cured, such as a membrane crack or a circuit wire breaking, can be minimized.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE PREFERRED EMBODIMENTS

Hereinafter, preferred embodiments of an ink cartridge of an inkjet printer according to the present invention will be described in detail with reference to the accompanying drawings.

Figure 1A:
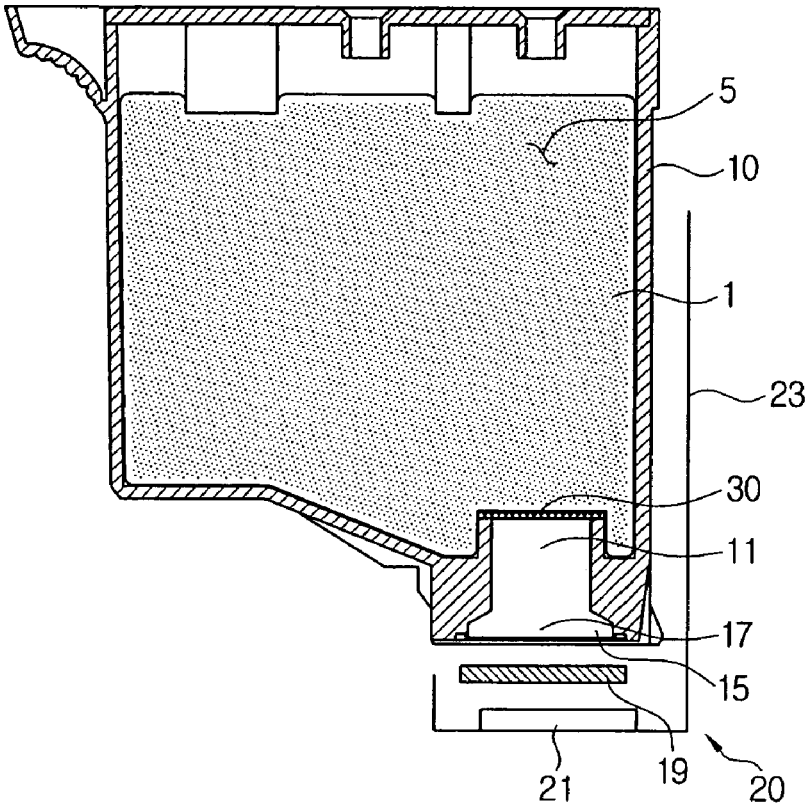
FIG. 1A (PRIOR ART)
FIGS. 1A and 1B show a sectional side view and a bottom view, respectively, of a conventional inkjet cartridge of an inkjet printer.
Figure 1B:
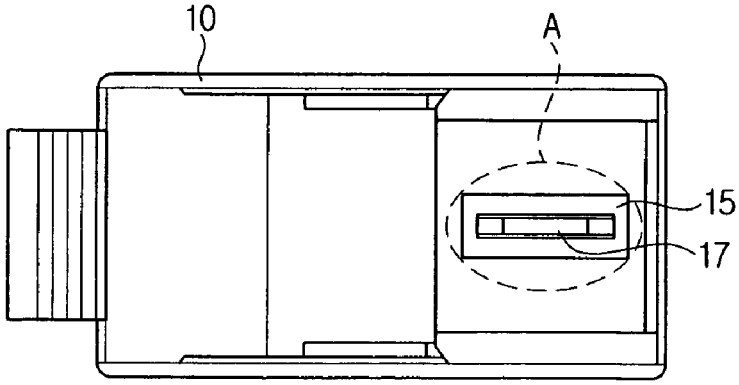
FIG. 1B (PRIOR ART)
Figure 5A:
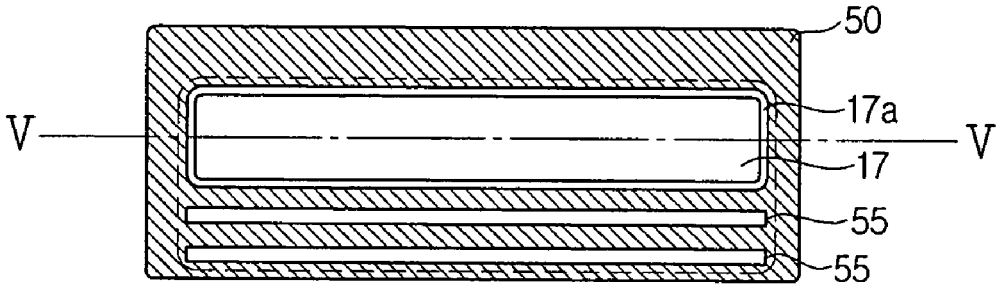
FIGS. 5A and 5B show a bottom view and a sectional view, respectively, of the print head unit of the ink cartridge according to a first embodiment of the present invention.
Figure 5B:
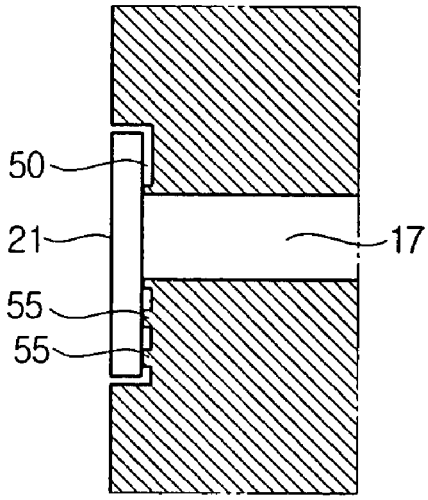

FIGS. 5A and 5B schematically show a print head receiving part of an ink cartridge according to an embodiment of the present invention. Referring to FIGS. 1A, 5A and 5B, the ink cartridge according to the present invention comprises a housing 10, a filter 30, and a print head unit 20. Hereinafter, only a mono-ink cartridge will be described by way of an example. However, the present invention can be also applied to a color-ink cartridge in the same manner.

The housing 10 includes an ink chamber 1 for storing an ink, and a stand pipe chamber 11 which serves as an ink path at one lower side thereof. The housing 10 is mounted removably to a cartridge frame (not shown) of the inkjet printer system. As the housing 10 moves in association with the cartridge, a desired image is printed by the ink ejected from the print head unit 20.

In the ink chamber 1, a porous member 5 such as a sponge is inserted for holding the ink, in order to prevent any ink leakage of the ink cartridge from contaminating the vicinity in case that the ink cartridge is tipped. Accordingly, the ink contained in the porous member 5 is flowed into the stand pipe chamber 11.

The filter 30 is disposed between the ink chamber 1 and the stand pipe chamber 11 to filter out the contaminant from the ink when the ink flows from the ink chamber 1 to the stand pipe chamber 11. The filter 30 may be formed as a fine wire netting.

The print head unit 20 comprises a head chip 21 and a flexible circuit board 23. The head chip 21 has a heating element (not shown) for heating the ink, and a plurality of nozzle holes (not shown). The flexible circuit board 23 transmits a signal from a printer system to the head chip 21. The ink is moved to the head chip 21 passing through the ink chamber 1, the filter 30, and the stand pipe chamber 11. Then, the ink is heated by the heating element, and discharged to the outside through the nozzle hole. The head chip 21, to which the flexible circuit board 23 of the print head unit 20 is connected, is receivingly fixed in the receiving part 50 which is formed at the bottom of the housing 10 near the stand pipe chamber 11.

More specifically, the receiving part 50 is formed such that the print head unit 20 is receivingly fixed in the bottom of the housing 10 near the stand pipe chamber 11, by the adhesive 19 such as a thermosetting epoxy.

The thermosetting epoxy 19 is heat-hardened, and functions as a sealant which prevents the ink from leaking onto any parts other than the print head unit 20. In the case of a color-ink cartridge, the adhesive 19 also prevents color inks from mixing with each other.

At a bottom of the receiving part 50, the ink feed hole 17 is formed so that the ink is supplied from the ink chamber 1. The ink feed hole 17 is extended in a direction of a nozzle array which is formed in the head chip 21 of the print head unit 20.

Figure 2A:
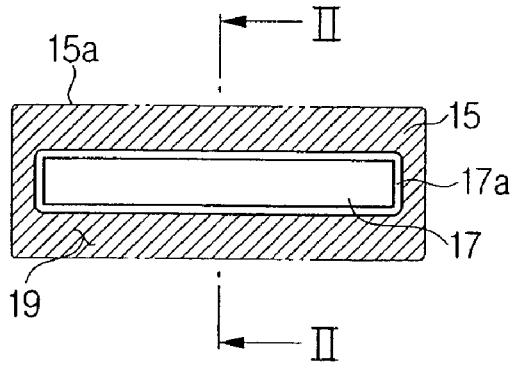
FIG. 2A (PRIOR ART)
FIGS. 2A and 2B show an enlarged bottom view and a sectional view, respectively, of part 'A' of FIG. 1B.
Figure 2B:
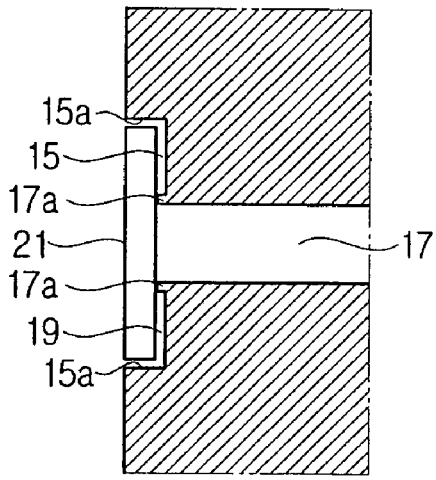
FIG. 2B (PRIOR ART)
Figure 2C:
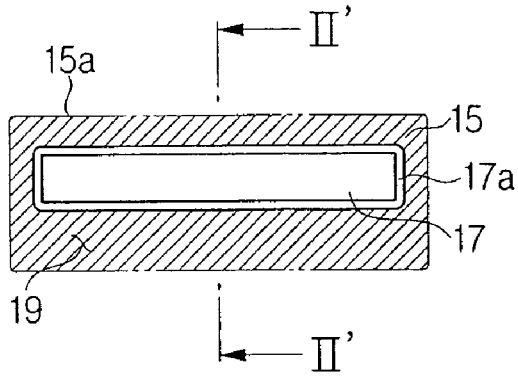
FIG. 2C (PRIOR ART)
FIGS. 2C and 2D show another enlarged bottom view and another sectional view, respectively, of part 'A' of FIG. 1B.
Figure 2D:
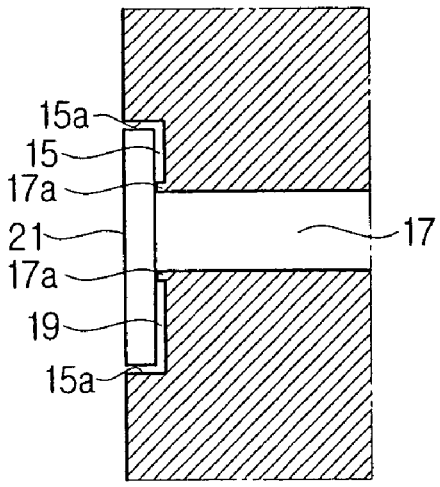
FIG. 2D (PRIOR ART)
Figure 3A:
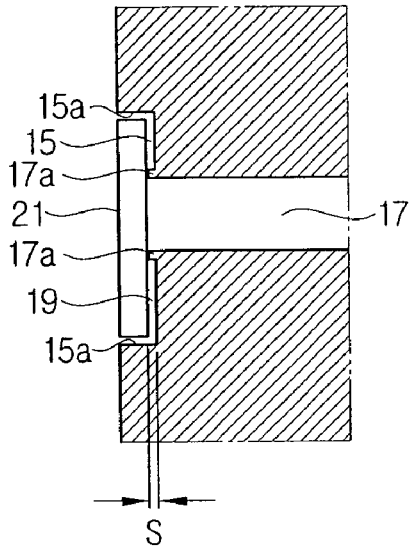
FIG. 3A (PRIOR ART)
FIGS. 3A and 3B illustrate an ink cartridge of FIG. 1A.
Figure 3B:
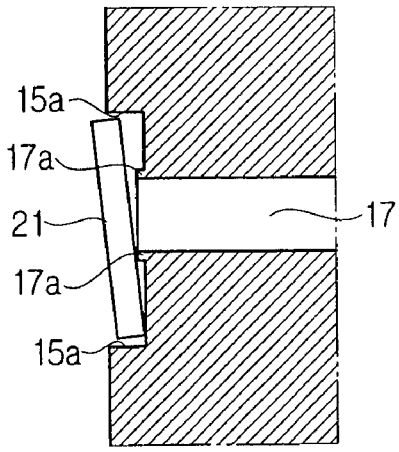
FIG. 3B (PRIOR ART)
Figure 4A:
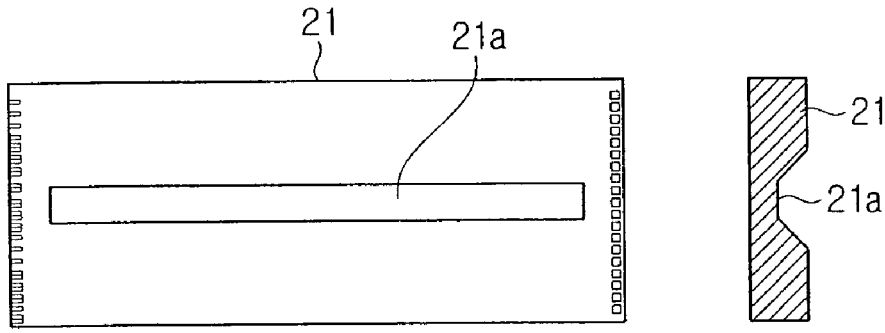
FIG. 4A (PRIOR ART)
FIGS. 4A and 4B illustrate a print head unit of FIG. 1A.
Figure 4B:
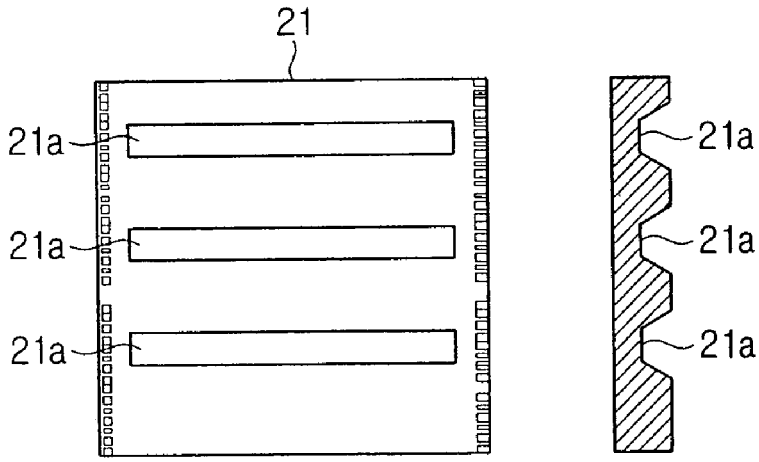
FIG. 4B (PRIOR ART)

On a circumference of the ink feed hole 17, a dam 17*a* is formed to prevent the thermosetting adhesive 19 from flowing back to the ink feed hole 17. Additionally, as shown in FIG. 5A, a secondary dam 55 is formed, on the bottom area of the receiving part 50 where the dam 17*a* is not formed and the adhesive 19 is applied more broadly. On the other hand, albeit not shown, in the case that the ink feed hole 17 is formed in the middle of the receiving part 15, as shown in FIG. 2A, the secondary dam 55 may be formed at one or both sides of the receiving part 50.

Figure 5C:
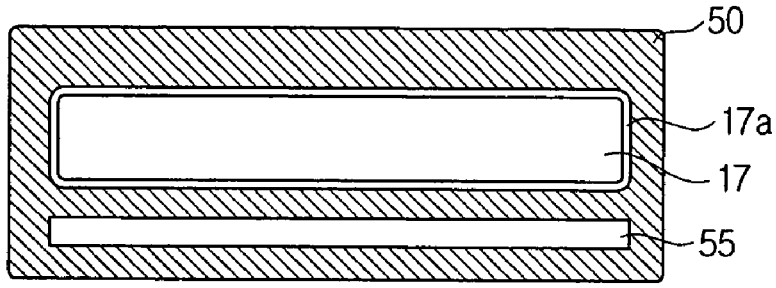
FIGS. 5C and 5D schematically show the print head unit of the ink cartridge according to a second and a third embodiments, respectively, of the present invention.
Figure 5D:
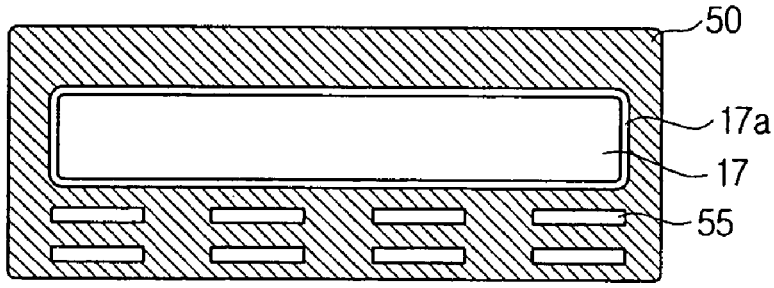

The secondary dam 55 is the main feature of the present invention, which causes the head chip 21 to be attached parallel to the printing paper when attaching the print head unit 20. Therefore, the secondary dam 55 is formed at the same height as the dam 17*a* on the circumference of the ink feed hole 17. According to a first embodiment of the present invention shown in FIG. 5A, a pair of secondary dams 55 are formed parallel to each other in a direction of the ink feed hole 17. Alternatively, according to a second embodiment of the present invention, as shown in FIG. 5C, a single secondary dam 55 can be extended parallel to the ink feed hole 17 direction. Yet alternatively, a third embodiment of the present invention is employable in which a plurality of secondary dams 55 are formed as shown in FIG. 5D.

Such secondary dam 55 can minimize a generation of a crack in vulnerable parts of the chip 21, wire breaking, and breaking of electric patterns thereon, although heat stress occurs on the head chip 21 of the print head unit 20 due to the thermosetting adhesive 19 being heat hardened and extended.

According to the preferred embodiments of the present invention, areas where the adhesive 19 is applied are symmetrically formed with respect to the ink feed hole 17, so that the head chip 21 is stably maintained parallel to the printing paper when the print head unit 20 is attached. In other words, sealant-applied areas above V—V line and below V—V line of FIG. 5A are equally formed so that the heat stress becomes even.

In addition, it is preferred that a rectangular area defined by outer circumference of the dam 17*a* and the secondary dam 55, that is, an area shown by a dotted line in FIG. 5A, is more than a half of the whole area of the receiving part. By having the dam 17*a* and the secondary dam 55 in the area, the head chip 21 is supported, and accordingly, reliability of parallel support of the head chip 21 can be improved.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. An ink cartridge of an inkjet printer comprising:

a print head unit comprising a head chip in which a plurality of nozzle holes are formed to fire ink onto a printing paper, and a flexible circuit board for transceiving signals with a printer system; and a housing comprising a receiving part formed at one side of the bottom thereof to receive and fix the print head unit therein, the receiving part having an ink feed hole including a dam on its perimeter to support the head chip, and a separate secondary dam of the same height as the dam which also supports the head chip, and an ink chamber disposed therein.

2. The ink cartridge of claim 1, wherein the housing comprises a stand pipe chamber formed therein near the receiving part.

3. The ink cartridge of claim 2, further comprising a filter disposed between the ink chamber and the stand pipe chamber to filter the ink which is supplied to the print head unit.

4. The ink cartridge of claim 1, wherein the print head unit is receivingly fixed by an adhesive in the receiving part, in an area where the dam and the secondary dam are not formed.

5. The ink cartridge of claim 4, wherein, in the adhesive-applied area in the receiving part, the secondary dam is formed in a broader side with respect to the ink feed hole.

6. The ink cartridge of claim 5, wherein the secondary dam is formed such that the adhesive-applied areas are symmetrical with respect to the ink feed hole.

7. The ink cartridge of claim 1, wherein an area defined by an outer perimeter of the dam and the secondary dam is larger than a half of the whole area of the receiving part.

8. The ink cartridge of claim 1, wherein the secondary dam is extended parallel to the ink feed hole.

9. The ink cartridge of claim 1, further comprising a plurality of the secondary dams, wherein at least one of the secondary dams are extended in a direction of the ink feed hole and parallel reciprocally.

10. An ink cartridge of an inkjet printer comprising:

a print head unit comprising a head chip with a plurality of nozzle holes for firing ink onto a printing paper; and a housing comprising a receiving part for receiving the print head unit, the receiving part having an ink feed hole for supplying ink to the print head unit, a first dam formed around the perimeter of the ink feed hole for supporting the head chip, and at least one separate secondary dam of the same height as the first dam for supporting the head chip, wherein the at least one secondary dam is spaced away from the first dam.

11. The ink cartridge of claim 10, wherein the at least one secondary dam is substantially parallel to the ink feed hole.

12. The ink cartridge of claim 10, wherein the at least one secondary dam comprises a pair of secondary dams which are formed substantially parallel to each other in a direction of the ink feed hole.

13. The ink cartridge of claim 10, wherein the at least one secondary dam comprises a plurality of secondary dams.

14. The ink cartridge of claim 10, wherein the print head unit is fixed by an adhesive in the receiving part, in an area where the first dam and the secondary dam are not formed.

15. The ink cartridge of claim 10, wherein an area defined by an outer perimeter of the first dam and the secondary dam is larger than half of the whole area of the receiving part.

16. A housing for an ink cartridge of an inkjet printer comprising:

a housing with an ink chamber disposed therein;

a receiving part disposed on the housing for receiving a print head unit;

an ink feed hole formed at a bottom of the receiving part for supplying ink from the ink chamber to the print head unit;

a first dam disposed about the ink feed hole on the bottom of the receiving part for supporting the head chip, the first dam protruding outwardly from the bottom of the receiving part; and at least one separate secondary dam protruding outwardly from the bottom of the receiving part for supporting the head chip, the first dam and the at least one second secondary dam having the same height.

17. The ink cartridge of claim 16, wherein the at least one separate secondary dam is substantially parallel to the ink feed hole.

18. The ink cartridge of claim 16, wherein the at least one secondary dam comprises a pair of secondary dams which are formed substantially parallel to each other in a direction of the ink feed hole.

19. The ink cartridge of claim 16, wherein the at least one secondary dam comprises a plurality of secondary dams.

20. The ink cartridge of claim 16, wherein an area defined by an outer perimeter of the first dam and the secondary dam is larger than half of the whole area of the receiving part.

* * * * *